US007207216B2

(12) United States Patent
Meister et al.

(10) Patent No.: US 7,207,216 B2
(45) **Date of Patent: *Apr. 24, 2007**

(54) HYDRAULIC AND MECHANICAL NOISE ISOLATION FOR IMPROVED FORMATION TESTING

(75) Inventors: Matthias Meister, Celle (DE); Sven Krueger, Celle (DE); Christian Liss, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/134,914

(22) Filed: May 23, 2005

(65) Prior Publication Data

US 2005/0205302 A1 Sep. 22, 2005

Related U.S. Application Data

(63) Continuation of application No. 10/465,173, filed on Jun. 19, 2003, now abandoned, which is a continuation-in-part of application No. 09/703,645, filed on Nov. 1, 2000, now Pat. No. 6,581,455.

(51) Int. Cl.
*E21B 47/08* (2006.01)
*E21B 44/00* (2006.01)

(52) U.S. Cl. ..... 73/152.55; 73/152.46; 73/152.26; 166/264

(58) Field of Classification Search ..... 73/125.55, 73/152.05, 152.46, 152.26; 702/9; 166/264, 166/250.01; 175/50
See application file for complete search history.

(56) References Cited

U.S. PATENT DOCUMENTS

| | | | | |
|---|---|---|---|---|
| 3,677,081 | A | 7/1972 | Newton et al. | 73/155 |
| 4,573,532 | A | 3/1986 | Blake | 166/264 |
| 4,635,717 | A | 1/1987 | Jageler | 166/250 |
| 4,733,233 | A | 3/1988 | Grosso et al. | 340/861 |
| 4,860,580 | A | 8/1989 | DuRocher | 73/155 |
| 5,233,866 | A | 8/1993 | Desbrandes | 73/155 |
| 5,799,733 | A | 9/1998 | Ringgenberg et al. | 166/264 |
| 5,803,186 | A | 9/1998 | Berger et al. | 175/50 |
| 5,803,786 | A | 9/1998 | McCormick | 446/227 |
| 6,041,860 | A | 3/2000 | Nazzal et al. | 166/250.01 |
| 6,047,239 | A | 4/2000 | Berger et al. | 702/9 |
| 6,157,893 | A | 12/2000 | Berger et al. | 702/9 |
| 6,581,455 | B1 | 6/2003 | Berger et al. | 73/152.55 |

FOREIGN PATENT DOCUMENTS

| | | |
|---|---|---|
| WO | WO96/30628 | 10/1996 |
| WO | WO99/45236 | 10/1999 |

*Primary Examiner*—Michael Cygan
(74) *Attorney, Agent, or Firm*—Madan Mossman & Sriram PC

(57) ABSTRACT

An apparatus and method for isolating a downhole tool section from hydraulic and mechanical noise. Anchoring grippers are used in conjunction with a fluid diverter valve to anchor the tool section to a borehole wall and divert fluid flowing in the drill string away from sensitive test equipment during formation testing.

43 Claims, 7 Drawing Sheets

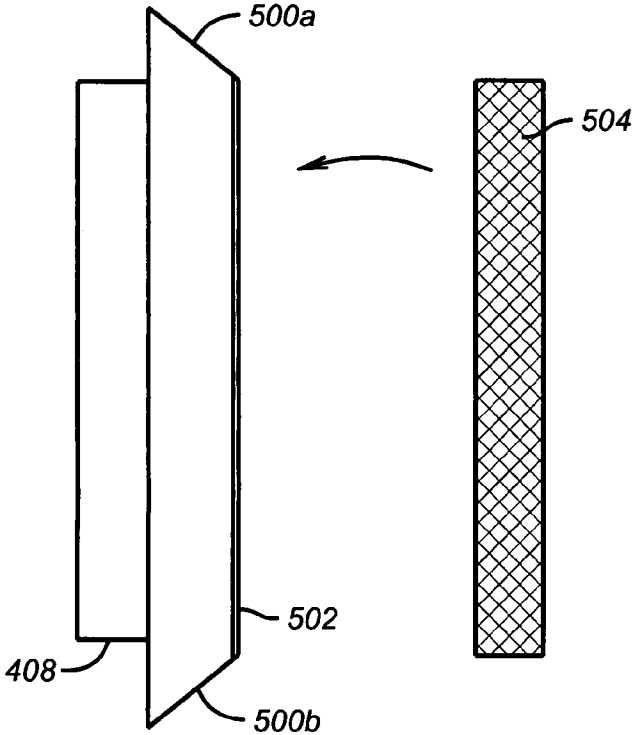
Elongated Gripper with Textured Pad
FIG. 5A FIG. 5B
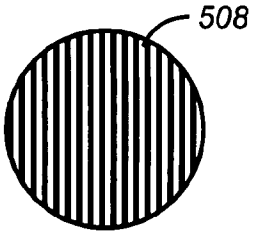
Raised Points
FIG. 5C
Ridges
FIG. 5D
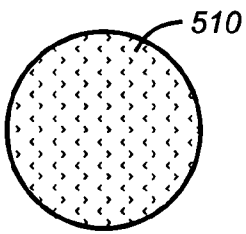
Dimpled
FIG. 5E
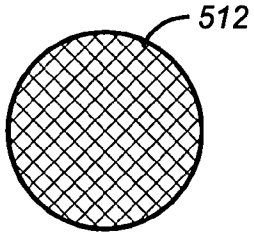
Cross Hatch
FIG. 5F
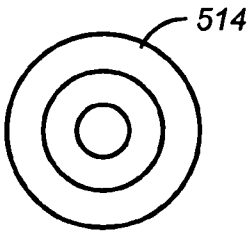
Circular Pattern
FIG. 5G

HYDRAULIC AND MECHANICAL NOISE ISOLATION FOR IMPROVED FORMATION TESTING

CROSS REFERENCE TO RELATED APPLICATIONS

This application is continuation of the U.S. patent application having the Ser. No. 10/465,173 filed Jun. 19, 2003 now abandoned, which application is a continuation-in-part of U.S. patent application Ser. No. 09/703,645 filed Nov. 1, 2000 now U.S. Pat. No. 6,581,455. All prior applications being hereby fully incorporated herein by reference.

BACKGROUND OF THE INVENTION

1. Field of the Invention

This invention relates to the testing of underground formations or reservoirs. More particularly, this invention relates to a method and apparatus for isolating a downhole test tool from vibration and noise due to heave and/or drilling fluid circulation during formation testing.

2. Description of the Related Art

While drilling a well for commercial development of hydrocarbon reserves, several subterranean reservoirs and formations are encountered. In order to discover information about the formations, such as whether the reservoirs contain hydrocarbons, logging devices have been incorporated into drill strings to evaluate several characteristics of these reservoirs. Measurement-while-drilling systems (hereinafter MWD) have been developed that contain resistivity, nuclear and other logging devices which can constantly monitor formation and reservoir characteristics during drilling of well boreholes. The MWD systems can generate data that include information about the presence of hydrocarbon, saturation levels, and formation porosity. Telemetry systems have been developed for use with the MWD systems to transmit the data to the surface. A common telemetry method uses a mud-pulsed system, an example of which is found in U.S. Pat. No. 4,733,233 incorporated herein by reference. MWD systems provide real time analysis of the subterranean reservoirs.

Commercial development of hydrocarbon fields requires significant amounts of capital. Before field development begins, operators desire to have as much data as possible in order to evaluate the reservoir for commercial viability. Despite the advances in data acquisition during drilling using the MWD systems, it is often necessary to conduct further testing of the hydrocarbon reservoirs in order to obtain additional data. Therefore, after the well has been drilled, the hydrocarbon zones are often tested by other test equipment.

One type of post-drilling test involves producing fluid from the reservoir, collecting samples, shutting-in the well and allowing the pressure to build-up to a static level. This sequence may be repeated several times for different reservoirs within a given borehole. This type of test is known as a "Pressure Build-up Test." One of the important aspects of the data collected during such a test is the pressure build-up information gathered after drawing the pressure down. From this data, information can be derived as to permeability and size of the reservoir. Further, actual samples of the reservoir fluid are obtained and tested to gather Pressure-Volume-Temperature data relevant to hydrocarbon distribution in the reservoir.

The drill string is often retrieved from the well borehole to perform these tests in an operation known as tripping. A different tool designed for the testing is then run into the well borehole. A wireline is then used to lower a test tool into the well borehole. The test tool sometimes utilizes packers for isolating the reservoir. Alternatively, a wire line can be lowered from the surface, into a landing receptacle located within a drill string test tool, establishing electrical signal communication between the surface and the test assembly. Regardless of the type of test tool and type of communication system used, the amount of time and money required for retrieving the drill string and/or running a second test tool into the borehole is significant. Further, if the borehole is highly deviated, a wire line tool is difficult to use to perform the testing.

Various MWD tools have been developed to allow for the pressure testing and fluid sampling of potential hydrocarbon reservoirs as soon as the borehole has been drilled into the reservoir, without removal of the drill string. These MWD tools also reduce the risks associated with pressure kick, because the drilling fluid pressure can be monitored and maintained better when tripping is avoided.

The typical MWD tool, however, suffers in that vibrations caused by flowing drilling fluid, mud pumps, drilling motors and surface equipment are transmitted to the test device through the drill string or even directly in the case of flowing drilling fluid. These vibrations often adversely affect test results, because the downhole instrumentation can be too sensitive to operate effectively in mechanically noisy environment.

Another problem is associated with vertical movement known as heave encountered when drilling in an offshore environment. Heave movement can cause pressure leaks where probe sealing pads and packers engage the borehole wall to form a seal. Heave movement can also result in excessive wear on soft materials used for sealing against the borehole wall. Although such heave is normally associated with offshore drilling, any unwanted vertical movement while a seal is engaged with the borehole wall can damage the seal material or cause unwanted leaks. Therefore, the use of the term heave is not meant to limit the usefulness of the present invention to offshore drilling environments. The present invention addresses the need to have a MWD tool that provides protection to sensitive test devices and protects soft sealing materials from unwanted movements that cause excessive wear on such materials.

SUMMARY OF THE INVENTION

A formation testing method and a test apparatus are disclosed. The test apparatus is mounted on a work string for use in a well borehole filled with fluid. It can be a work string designed for drilling, re-entry work, or workover applications in either on or offshore drilling operations. The work string is preferably adapted for conveying into highly deviated holes, horizontally, or even uphill. The work string preferably includes a Measurement While Drilling (MWD) system and a drill bit, or other operative elements.

One aspect of the present invention provides a downhole tool for acquiring a parameter of interest. The tool being conveyed into a well borehole on a work string having a rotatable bit at a distal end thereof. The tool includes an independently extendable gripper element disposed on the work string, wherein the extendable gripper element forcibly engages the borehole wall to anchor at least a portion of the drill string radially, axially and circumferentially while the borehole wall is engaged by the gripper element. A diverter valve is coupled to the drill string either above or below the gripper element to divert drilling fluid into the annulus. A test device is coupled to the work string for determining the parameter of interest.

In another aspect of the present invention a system for acquiring a downhole parameter of interest while drilling a borehole through a formation includes a drill string having a rotatable bit at a distal end thereof. An independently extendable gripper element is disposed on the drill string to forcibly engage the borehole wall to anchor at least a portion of the drill string radially, axially and circumferentially while the borehole wall is engaged by the extendable gripper element. A diverter valve is preferably coupled to the drill string above the grippers to divert drilling fluid into the annulus. A test device is coupled to the drill string portion and includes a sensor for measuring a desired downhole characteristic and for providing an output signal representative of the measured characteristic. A processor receives and processes the output signal, the processed signal being indicative of the parameter of interest.

A method of isolating a downhole test device from noise is also provided. The method includes conveying a drill string into a well borehole, the drill string having a rotatable bit at a distal end thereof and an inner bore for conveying drilling fluid from a surface location to the drill bit. A drill string portion is anchored to the borehole wall using an independently extendable gripper element. The method includes diverting drilling fluid above the anchored drill string portion using a diverter valve, and obtaining a desired characteristic using a sensor disposed on the anchored drill string portion.

The gripper elements may be incorporated on the work string or on a non-rotating sleeve. The grippers are extendable and are used to engage the borehole wall. Once the borehole wall is engaged, the grippers anchor the work string or non-rotating sleeve such that the work string or non-rotating sleeve remains substantially motionless during a test, i.e. to prevent movement radially, axially and circumferentially while the borehole wall is engaged by the gripper element. The advantage of anchoring the tool is increased useful life of soft components such as pad members and packers and to reduce noise caused by vibrations associated with the work string that adversely affect sensitive test equipment and test data.

An advantage of the present invention includes use of the pressure and resistivity sensors with the MWD system, to allow for real time data transmission of those measurements. Another advantage is that the present invention allows obtaining static pressures, pressure build-ups, and pressure draw-downs with the work string such as a drill string in place and in an extremely quiet environment free of vibration and movement.

BRIEF DESCRIPTION OF THE DRAWINGS

For a detailed understanding of the present invention, references should be made to the following detailed description of the preferred embodiment, taken in conjunction with the accompanying drawings, in which like elements have been given like numerals and wherein:

FIGS. 5A–G show various textures for a gripper surface for increasing friction between the gripper and borehole wall;

DESCRIPTION OF THE PREFERRED EMBODIMENTS

Figure 1A:
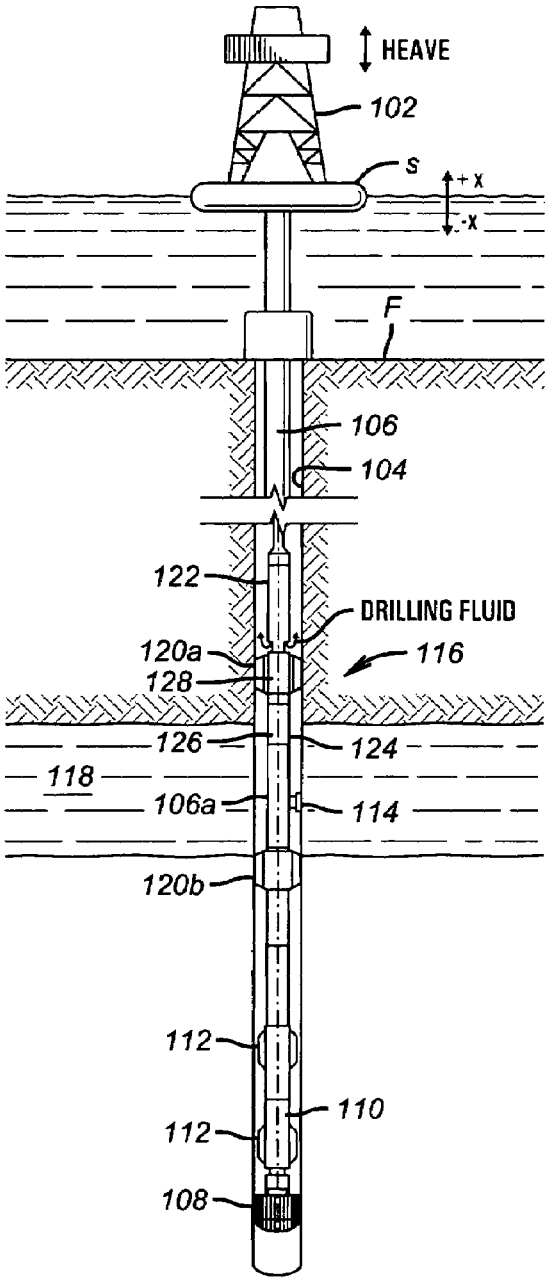
FIGS. 1A–B are elevation views of the apparatus of the present invention as it would be used with a floating drilling rig.
Figure 1B:
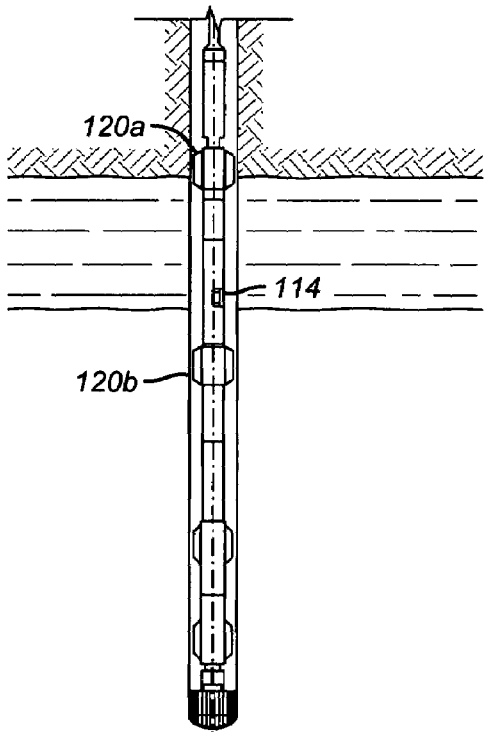

Referring to FIG. 1, a typical drilling rig 102 with a well borehole 104 extending therefrom is illustrated, as is well understood by those of ordinary skill in the art. The drilling rig 102 has a work string 106, which in the embodiment shown is a drill string. The work string 106 has attached thereto a drill bit 108 for drilling the well borehole 104. The present invention is also useful in other types of work strings, and it is useful with jointed tubing as well as coiled tubing or other small diameter work string such as snubbing pipe. Therefore, the term "work string" as used herein includes each of these several types of work string. FIG. 1 depicts the drilling rig 102 positioned on a drill ship S with a riser extending from the drilling ship S to the sea floor F. If applicable, the work string 106 can have a downhole drill motor 110 for rotating the drill bit 108. The drill bit might be rotated using a surface motor rotating a drill pipe. Fixed ribs or stabilizers 112 are positioned at the lower portion of the work string 106 to stabilize the string as drilling progresses.

Incorporated in the drill string 106 above the drill bit 108 is a tool 116. The tool 116 includes a test device 114 for testing formation fluid or other properties of a traversed reservoir 118. The tool 116 is a portion of the overall work string 106 and includes one or more gripper elements 120*a* and 120*b* to anchor a portion 106*a* of the work string 106. In a preferred embodiment at least one gripper element 120*a* is located above the test device 114, and a diverter valve 122 is disposed above or uphole of the upper gripper element 120*a*. As will be described in more detail later, one embodiment includes a diverter valve below an upper gripper element 120*a* to operate a force multiplier.

The gripper elements 120*a*/120*b* are extendable to engage the borehole wall 104. Once engaged the gripper elements are forcefully pressed against the wall to anchor the portion 106*a* of the work string 106, which might contain sensitive test devices 114. Such anchoring isolates the test device 114 from unwanted vibrational and other mechanical noise while formation tests are performed. The isolation is particularly desirable when the test device includes sensitive test elements such as a nuclear logging instrument. Another desirable aspect of anchoring the test portion is protecting from excessive wear soft materials such as seals used to isolate an area of the borehole wall. The gripper elements operate to anchor the drill string portion radially, axially and circumferentially while tests are performed. As used herein, anchoring means to forcefully couple a device or work string portion to the borehole wall to restrain the anchored portion from movement in axial, radial and/or circumferential directions. Such anchoring prevents vertical motion from destroying the seals and prevents pressure leaks by ensuring the sealing pads stay in place.

The tool 116 further includes a sensor system 124 that incorporates various sensors 126 useful for in situ formation testing. Examples of such sensors include pressure sensors, flow sensors, nuclear magnetic resonance ("NMR") sensors, resistivity sensors, porosity sensors, etc. . . . The tool can also include devices for sampling and testing formation fluid such as a sampling probe and/or packer. The tool can be incorporated into a drill stem tester, which is a large volume test device. The particular sensor and test device used is chosen based on the desired test. The present invention is useful in any such test using any such sensor where it is desirable to isolate the test device from mechanical and/or hydraulic noise.

Figure 2:
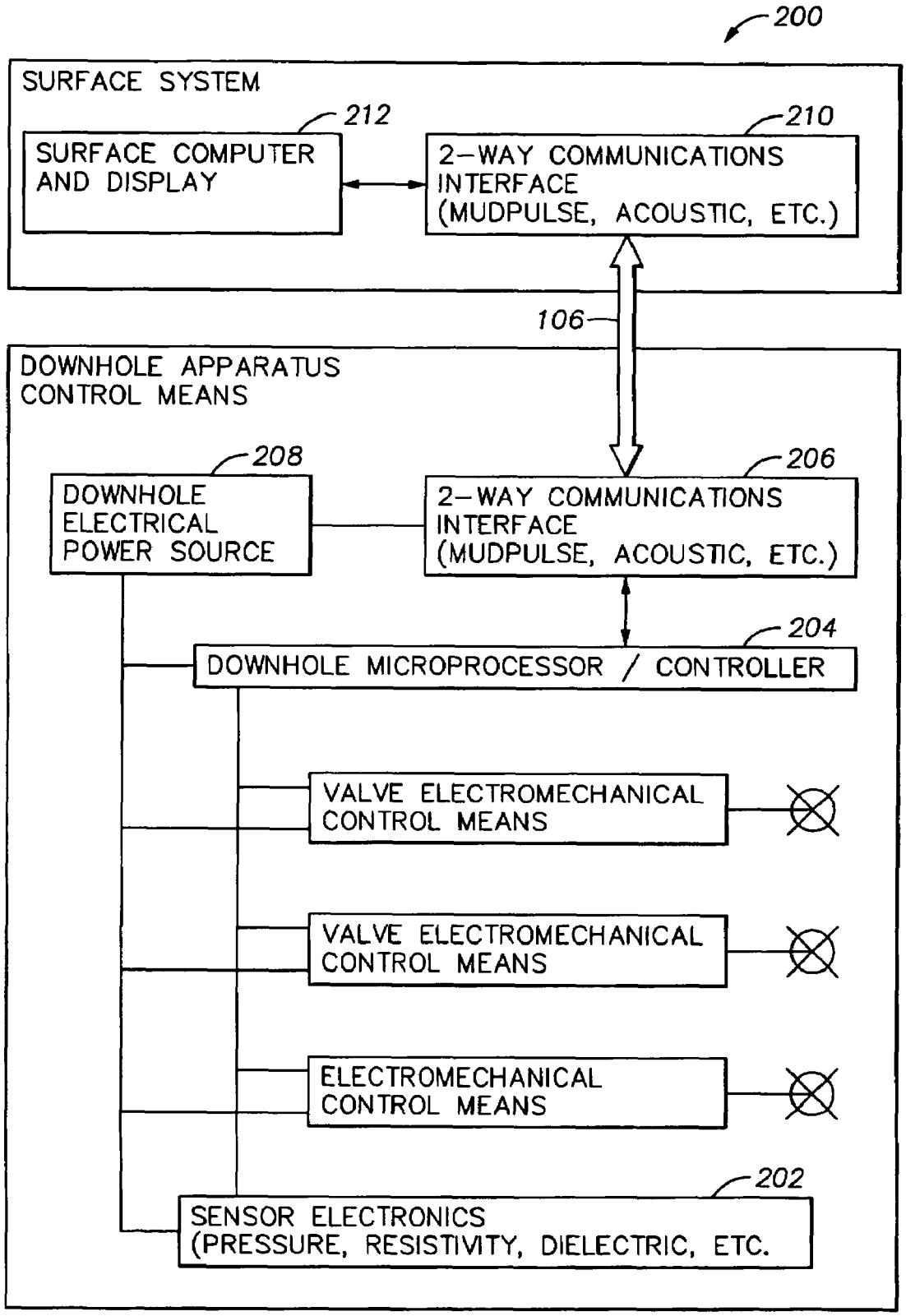
FIG. 2 is a functional block diagram of surface and downhole elements of the present invention.

As depicted in FIG. 2, the invention includes use of a control system 200 for controlling the various valves and pumps, and for receiving the output of the sensor system 124. The control system 200 is capable of processing the sensor information with a downhole microprocessor/controller 204, and delivering the data to a communications interface 206 so that the processed data can then be telemetered to the surface using conventional technology. It should be noted that various forms of transmission energy could be used such as mud pulse, acoustical, optical, or electromagnetic. The communications interface 206 can be powered by a downhole electrical power source 208. The power source 208 also powers the sensor system 124, the microprocessor/controller 204, and various valves and pumps.

Communication between downhole and surface equipment of the Earth can be effected via the work string 106 in the form of acoustic energy, pressure pulses through annular fluids or other methods well known in the art. In most cases, the transmitted information will be received at the surface via a 2-way communication interface 210. The data thus received will be delivered to a surface computer 212 for interpretation and display.

Command signals may be sent down the fluid column by the communications interface 210 to be received by the downhole communications interface 206. The signals so received are delivered to the downhole microprocessor/controller 204. The controller 204 will then signal the appropriate valves and pumps for operation as desired.

A bi-directional communication system as known in the art can be used as the interface 206. The purpose of the two-way communication system or bi-directional data link being to receive data from the downhole tool and to be able to control the downhole tool from surface by sending messages or commands. In one embodiment the only command is to initiate testing and the downhole controller conducts a desired test autonomously thereafter.

Data measured from the downhole tool 116 is preferably transmitted to the surface in order to utilize the measured data for real-time decisions and monitoring the drilling process. The data typically relate to measurements that are obtained from the subsurface formation, such as formation pressure information, information about optical properties or resistivity of the fluid, annulus pressure, pressure build-up or draw-down data, etc. The tool preferably transmits information that used to control the tool during its operation. For instance, information about pressure inside packers versus pressure in the annulus might be monitored to determine seal quality, information about fluid properties from the optical fluid analyzer or the resistivity sensor might be used to monitor when a sufficiently clean fluid is being produced from the formation, or status information pertaining to completion of operational steps might be monitored so that the surface operator, if required, can determine when to activate the next operational step. One example could be that a code is pulsed to surface when an operation is completed, for instance, activation of packer elements or extending a pad or other device to engage contact with the borehole wall. This data, or code, is then used by the operator to control the operation of the tool. Additionally, the downhole tool could transmit to the surface information concerning the status of its health and information pertaining to the quality of the measurements.

Figure 3:
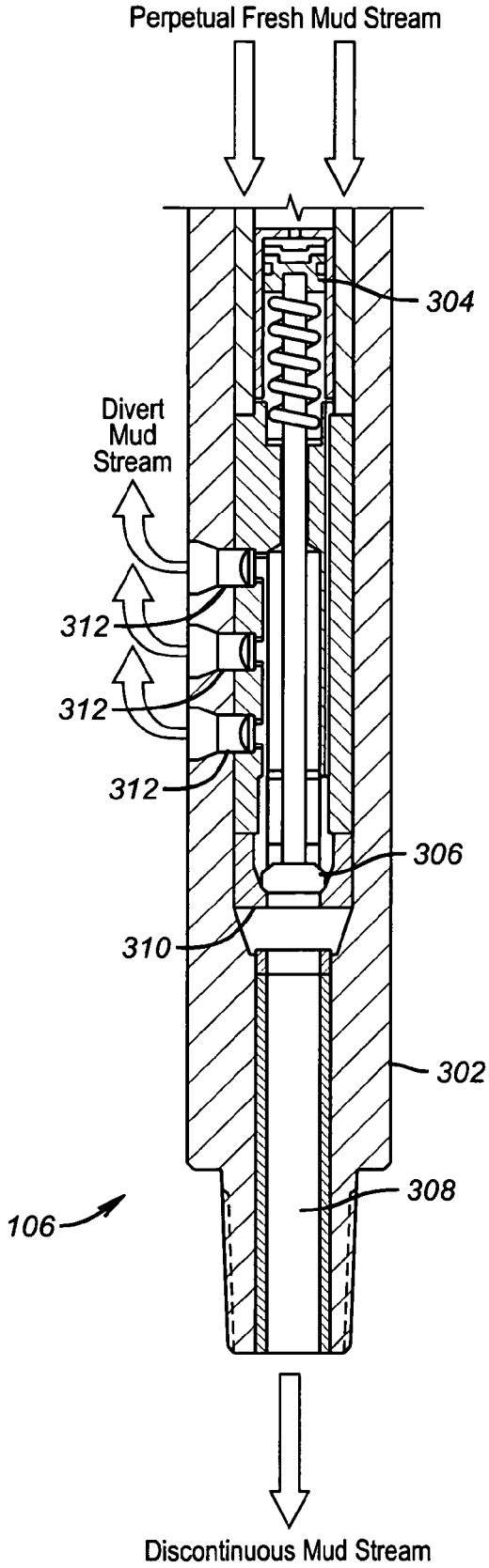
FIG. 3 is a cross section of a downhole tool portion according to an embodiment of the present invention showing a diverter valve.

FIG. 3 is a cross section of a downhole tool portion according to an embodiment of the present invention showing a diverter valve according to the present invention. Shown is a valve 300 disposed in a drill string portion 302. The valve 300 includes a hydraulic piston 304 that can be controlled from the surface or by a downhole controller 204. The hydraulic piston 304 operates to control a sealing device 306 in a main channel 308 of the drill string 106. The device 306 is preferably a plunger seal that seats in a beveled interior shoulder 310 of the drill string portion 302. When seated in the shoulder 310, the plunger 306 operates to interrupt fluid flow through the main channel 308.

The valve 300 further includes one or more flow valves 312 for diverting the fluid flowing in the main channel to the borehole annulus. This allows continued fluid flow above or uphole of the seal 306 to operate hydraulic components and downhole motors. When the main channel is sealed and the flow valves 312 are open, then any component downhole of the seal 306 is substantially isolated from hydraulic noise generated by fluid flow while allowing continued flow above the seal 306.

In one embodiment the valve is positioned above a packer 128 to isolate the test device or sensor system 124 from pressure variations and hydraulic noise in the annulus between the tool and borehole wall while diverter valve is diverting fluid. In one embodiment the valve is placed above an upper gripper 120*a* as shown in FIG. 1. In another embodiment not separately shown, the valve 300 is placed below a gripper to enable use of high pressure fluid in the main channel 308 in providing pressure for the gripper.

FIG. 4 is a cross section of a downhole tool portion according to an embodiment of the present invention showing a gripper element 400. The gripper element 400 is preferably disposed on a portion 402 of the drill string 106. The gripper element operates to forcefully engage the borehole wall to anchor at least the drill string portion 402 from movement axially, circumferentially and radially to isolate the portion from mechanical vibrations associated with drilling operations and fluid flow. The force required for such anchoring is dependent on various factors, namely drill string weight, weight on bit, weight of anchored portion, formation rock properties at the gripper location, etc. . . . Those skilled in the art with the benefit of this disclosure can determine the necessary force to provide such anchoring without causing serious damage to the borehole wall at the anchoring location.

The gripper element 400 includes a housing 404 and one or more high-force pistons 406. One or more gripper pads 408 are positioned on the pistons 406 so that the pistons 406 extend to forcefully press the pad 408 against the borehole wall 104. The pad 408 will typically press through mudcake build-up on the borehole wall to anchor against the underlying formation rock.

Anchoring force should be understood to be greater than the force required to merely provide back-up to an extendable probe used to sample formation fluid. The gripper, however, could be positioned to engage the borehole wall at the same depth as a sampling probe without damaging the probe. For example, two gripper elements can be angularly positioned +/−90 degrees from an extendable probe to provide anchoring according to the present invention as well as providing back-up force for the sampling probe without damaging the probe.

Figure 4A:
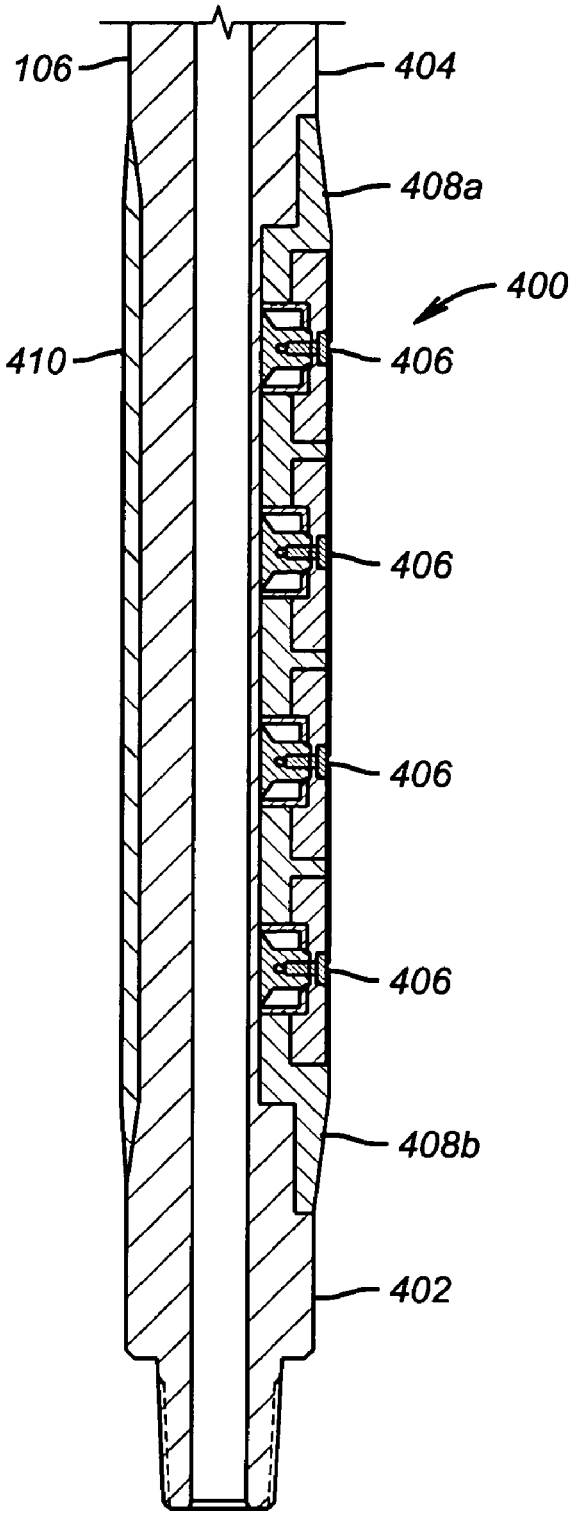
FIG. 4A is a cross section of a downhole tool portion according to an embodiment of the present invention showing a gripper element.

Various embodiments of the gripper element 400 can be used to provide effective anchoring. The embodiment of FIG. 4A shows a single elongated pad 408 extended by several individual pistons 406. The pad 408 is tapered at its ends 408*a* and 408*b* to facilitate retracting the gripper pad 408. A cross section of just the pad portion 408 is shown in FIG. 5A to show the feature of tapered ends 500*a* and 500*b* on a pad element 500 along with variations of a textured surface 502. Since the pad 408/500 will most likely press through mudcake and possibly even into rock, the tapered ends help ensure that the gripper does not become stuck or wedged into the formation. Although not apparent in the side view provided here, the surface 502 gripper pad 500 is preferably provided with a curvature complementary to borehole wall for better engagement therewith. Furthermore, the pad 500 further includes a textured surface to provide higher friction force between the pad and borehole wall.

In one embodiment the pad 408 is a tapered pad and generally circular with a shallow conical shape. The pad is pressed into the mudcake for gripping the borehole wall, and the conical shape enhances the ability to disengage the mudcake after a test. If the pad becomes stuck due to pressure differential or other cause, a movement of the drill string will help disengage the pad.

FIGS. 5B–G show various textures for a gripper surface 502 for increasing friction between the gripper and borehole wall. Exemplary yet non-limiting textured surfaces shown in FIGS. 5B–G can be either raised or indented patterns in the surface 502 of the pad 500. The surface pattern can be diamond 504, raised points 506, ridges (or grooves) 508, dimples 510, cross-hatch 512, and/or circular 514 patterns.

Figure 4B:
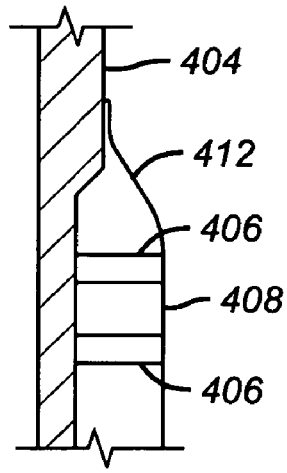
FIGS. 4B–C show alternative embodiments of the gripper element of FIG. 4A.
Figure 4C:
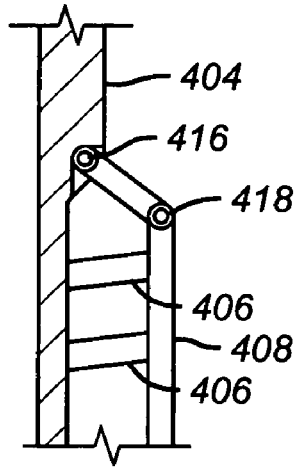

Referring still to FIG. 4A, the embodiment shown includes a fixed pad or housing portion 410 that engaged the borehole wall opposite of the gripper pad 408. The gripper pad 408 and both ends 408*a*/408*b* extend outwardly from the housing 404. FIG. 4B shows an embodiment having a flexible arm or member 412 attaching one end of the gripper pad 408 to the housing 404. FIG. 4C shows another embodiment having a pivoting member 414 attached to a pivot point 416 on the housing 404 and to a pivot point 418 on the gripper pad 408. Each of these alternative embodiments provides the ability to ensure the gripper element does not become stuck. Multiple grippers can also be disposed about the circumference of the tool housing to allow the tool to remain centralized in the borehole.

The gripper 400 can be disposed on the drill string 106 either above or below the diverter valve 300. Those skilled in the art with the benefit of this disclosure can easily determine how to best operate the gripper for the particular design chosen. For example, a gripper mounted below the diverter valve can be hydraulically operated using high pressure fluid in the interior channel of the tool by engaging the gripper before operating the diverter valve. Alternatively, the diverter valve can be fitted with a valve in the seal 306 to direct some fluid above the seal to the gripper pistons below the seal while still inhibiting fluid flow through the interior channel. A fluid force multiplier, which is known, can be used to provide additional force to effect anchoring. It is also contemplated to use a pump, either above or below the diverter valve to pump high pressure fluid directly to the gripper pistons.

Figure 6:
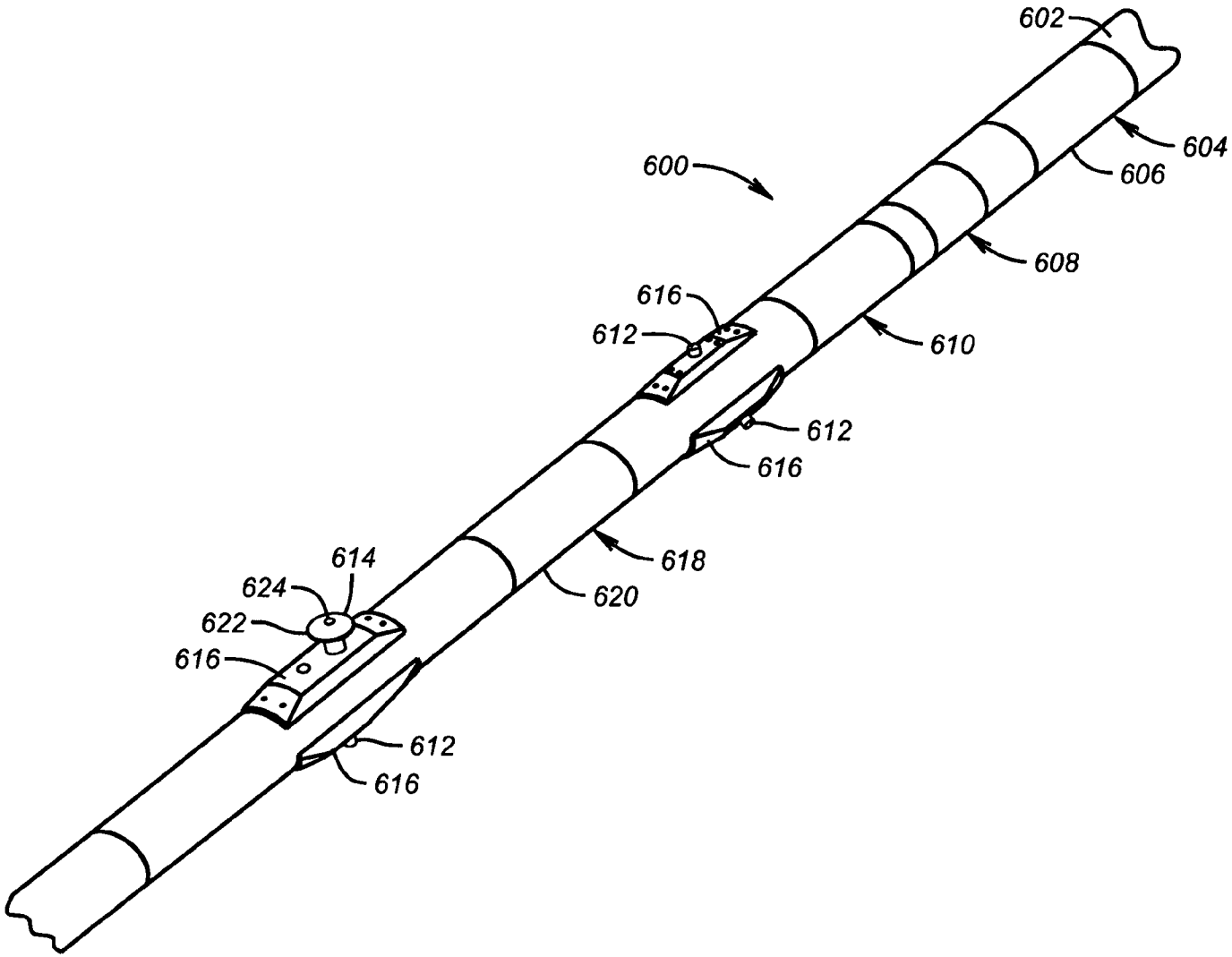
FIG. 6 is a perspective view of an embodiment of the present invention showing gripper elements integral to stabilizers and an extendible sealing pad element integral to a stabilizer.
Figure 7:
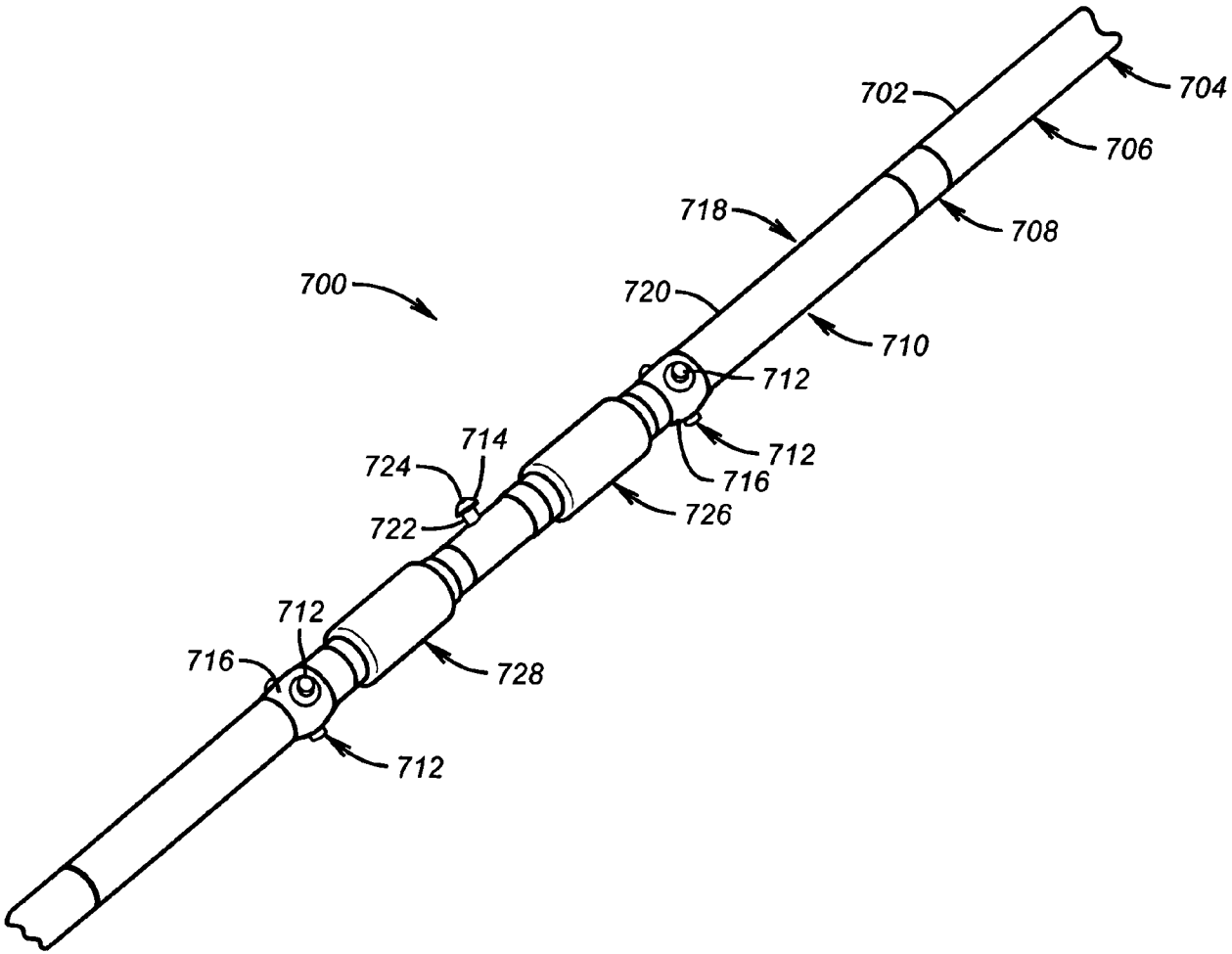
FIG. 7 is a perspective view of an embodiment of the present invention that includes integrated stabilizers and grippers, packers and an extendable sealing pad element.

FIGS. 6–7, taken with FIGS. 1–5G show preferred tool configurations according to the present invention. FIG. 6 shows a tool section 600 of a drill string 602 including a two-way communication system 604 and power supply 606 disposed at its upper end. The communication system 604 may comprise any number of well-known components suitable for the particular application and can be as described above and shown in FIG. 2 at 206. A diverter valve 608 is disposed on the tool section 600, and is preferably disposed below the power supply 606 to allow continued circulation of mud for operate the power supply while drilling is stopped for sampling and testing of a formation. The diverter valve 608 can be a valve substantially as described above and shown in FIG. 3 at 300. Shown disposed below the diverter valve 608 is an optional sample chamber section 610. Gripper elements 612 are mounted on the tool section 600 below the diverter valve 608 and sample chamber section 610. The grippers 612 are essentially as described above and shown in FIG. 4A at 400. The grippers are selectively and preferably independently extendable with respect to an extendable probe 614 and can engage the wall of a borehole to anchor the tool section 600 as described above. In the embodiment of FIG. 6, the grippers 612 might be integrated into one or more stabilizers 616, which operate to centralize the tool section 600 during drilling. The extension requirement for the anchoring grippers 612 are minimized in this embodiment, which creates a stronger and more stable anchoring system.

A pump 618 and at least one measurement sensor 620 such as a pressure sensor are disposed in the tool section 600 for taking and measuring samples of formation fluid. A pad sealing element 622 is disposed on the extendable probe 614, and a port 624 provides fluid communication to the pump 618 and pressure sensor 620. This embodiment further shows that the extendable probe 614 can be mounted on a stabilizer 616 to reduce travel length for extending the probe 614.

During drilling operations, drilling would be momentarily stopped for testing a formation. A command to open the diverter valve 608 may be issued from a surface location or from the controller 204 disposed in the tool section 600. The diverter valve 608 then opens in response to the command to allow continued mud circulation through the drill string 602 for operating the power supply 606. The grippers 612 are then extended to engage the borehole wall to anchor the tool section. Once the tool section 600 is anchored in place the probe 614 is extended to seal a portion of borehole and is isolated from hydraulic and mechanical vibrations and movement by use of the grippers 612 and diverter valve 608.

Once the pad 622 is in sealing contact with the borehole wall, the pump is activated to reduce the pressure at the port 624. When the pressure is reduced at the port 624 formation fluid enters the port. If samples are desired, the fluid is directed by internal valves to the sample chamber section 610. Measurements of fluid characteristics, such as formation pressure, are taken with the sensor 620. The communication system 604 is then used to transmit data representative of the sensed characteristic to the surface. The data may also be preprocessed downhole by the downhole processor 204 of FIG. 2 disposed in the tool section prior to transmitting the data to the surface.

FIG. 7 shows another embodiment of a tool section 700 according to the present invention in a typical drill string 702. The tool section 700 has a two-way communication system 704 and power supply 706 disposed at its upper end. The communication system 704 and the power supply 706 may be comprised of any well-known components suitable for the particular application and are substantially as described above and shown in FIGS. 2 and 6. A diverter valve 708 is disposed on the tool section 700, and in systems using a mud turbine power supply is typically disposed below the power supply 706 to allow continued operation of the power supply while drilling is stopped for sampling and testing of a formation. The diverter valve 708 is substantially as described above and shown in FIGS. 3 and 6. Shown disposed below the diverter valve 708 is an optional sample chamber section 710. Stabilizers 716 with integrated grippers 712 are mounted on the tool section 700 below the diverter valve 708 and sample chamber section 710. The grippers 712 and stabilizers 716 are essentially as described above and shown in FIGS. 4 and 6. The grippers 712 are selectively extendable and can engage a borehole to anchor the tool section 700. The lengths of the anchoring grippers 712 are thus minimized creating a stronger and more stable anchoring system.

A pump 718 and at least one measurement sensor 720 such as a pressure sensor are disposed in the tool section 700. The pump 718 and pressure sensor 720 are as described above and shown if FIG. 6. Upper and lower packers 726 and 728 are disposed on the tool section above and below a pad sealing element 714 mounted on an extendable probe 722. The packers 726 and 728 may be mud-inflatable packers as described above and are used to seal a portion of annulus around the pad sealing element 714 from the rest of the annulus. The extendable probe 722 is operatively associated with the pump 718 and pressure sensor 720. The probe 722 is selectively extendable as described above in FIG. 6 and extends the pad sealing element 714 to engage a borehole wall to seal a portion of the wall between the upper and lower packers 726 and 728. A port 724 located on the end of the pad sealing element 714 is in fluid communication with the pump 718 and measurement sensor 720. Another port (not shown separately) positioned on the tool section 700 between the packers 726 and 728 may be used in conjunction with the pump 718 to reduce the pressure between the packers to enhance sealing at the probe seal 724. This can be done by pumping the mud trapped between the packers 726 and 728 to the annulus above the upper packer 726. With pressure reduced between the packers below the pressure at the port a pressure differential is created between the port and the annulus between the packers thereby ensuring that any leakage at the port is formation fluid leakage from the port into the annulus rather than mud from the annulus leaking into the port. Another set of stabilizers 716 and grippers 712 may be positioned downhole of the lower packer 728 to provide added tool stabilization and anchoring during tests. A typical BHA including a drill bit (not shown) well known in the art, would be disposed on the drill string 702 downhole of the depicted tool section 700. Operation of the embodiment of FIG. 7 is substantially similar to that of FIG. 6.

There could be any number of variations to the above-described embodiments that do not require additional illustration. For example, alternate embodiments could be the embodiments of FIGS. 6–7 wherein separate grippers and stabilizers are used, or wherein grippers are used without stabilizers. An another useful embodiment, the tool section 600 or 700 us integrated into a non-rotating sleeve to allow continued motion of the drill string while anchoring the sensitive test section. Those skilled in the art would understand without further illustration that the sleeve could include a spring and bearing to allow progression of the drill bit while the gripper element anchors the nonrotating sleeve. In such an embodiment the test device can be adapted to determine a formation parameter of interest while the drill bit progress through the formation.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

We claim:

1. A downhole tool for acquiring a parameter of interest, the tool being conveyed into a borehole on a drill string, the tool comprising:

a) a test device coupled to the drill string for determining the parameter of interest;

b) a plurality of extendable gripper elements disposed on the drill string adjacent to the test device, the plurality of extendable gripper elements anchoring at least a portion of the drill string to a borehole wall to reduce mechanical noise at the test device; and c) a diverter valve coupled to the drill string, the diverter valve diverting drilling fluid from within the drill string into an annulus between the drill string and the borehole wall to reduce hydraulic noise at the test device.

2. The tool of claim 1, wherein each of the plurality of extendable gripper elements includes a textured pad mounted on the gripper element to increase frictional force between the borehole wall and the gripper element.

3. The tool of claim 2, wherein each pad is a single elongated pad attached to a housing using at least one of i) a flexible member coupling the pad to the housing and ii) a member coupling the pad to the housing at a pivot point.

4. The tool of claim 1, wherein each of the plurality of extendable gripper elements further includes one or more pistons and a pad, the one or more pistons operable to extend the pad to engage the borehole wall.

5. The tool of claim 4, wherein each pad has a conical shape pressed into mudcake when the extendable gripper element engages the borehole wall.

6. The tool of claim 2, wherein each of the textured pads includes a surface pattern selected from one or more of i) diamond; ii) raised points; iii) ridges; iv) grooves; v) dimpled; vi) cross hatch; and vi) circular.

7. The tool of claim 1 further comprising a hydraulic drive device for supplying hydraulic pressure to extend the plurality of gripper elements.

8. The tool of claim 7, wherein the hydraulic drive device comprises a motor and a pump for pumping drilling fluid at high pressure to extend the plurality of gripper elements.

9. The tool of claim 1, wherein the diverter valve includes a piston and a seal axially moveable by the piston to seal a main mud stream flow path and open an aperture for allowing the mud stream to enter the annulus uphole of the test device.

10. The tool of claim 1 further comprising an expandable packer coupled to the drill string below the diverter valve to isolate the test device from pressure variations in the annulus while the diverter valve is diverting fluid.

11. The tool of claim 1, wherein the test device comprises:

i) an extendable probe adapted to admit formation fluid into the test device; and ii) a sensor for sensing a characteristic of the admitted fluid, the sensed characteristic being used in part to determine the parameter of interest.

12. The tool of claim 1, wherein the drill string portion comprises a selectable non-rotating sleeve coupled to the drill string.

13. The tool of claim 12, wherein the test device is adapted to determine the parameter of interest while a drill bit connected to the drill string progresses through the formation.

14. The tool of claim 1, wherein the test device comprises a sensor for sensing a characteristic of the admitted fluid, the sensed characteristic being used in part to determine the parameter of interest, the sensed characteristic including one or more of i) temperature; ii) pressure; iii) formation fluid composition; iv) resistivity; v) water content; vi) mobility; and vi) nuclear properties.

15. A system for acquiring a downhole parameter of interest while drilling a borehole through a formation, the system comprising:

a) a drill string;

b) a test device coupled to the drill string, the test device including a sensor for measuring a desired downhole characteristic and for providing an output signal representative of the measured characteristic;

c) a plurality of extendable gripper elements disposed on the drill string adjacent to the test device, the plurality of extendable gripper elements anchoring at least a portion of the drill string to the borehole wall to reduce mechanical noise at the test device;

d) a diverter valve coupled to the drill string, the diverter valve diverting drilling fluid from within the drill string into an annulus between the drill string and the borehole wall to reduce hydraulic noise at the test device; and e) a processor processing the output signal, the processed signal being indicative of the parameter of interest.

16. The system of 15, wherein the processor is coupled to the drill string at a downhole location, the system further comprising a transmitter for transmitting the processed signal to a surface location.

17. The system of 15, wherein the processor is located at a surface location the system further comprising a transmitter for transmitting the output signal to the processor for surface processing.

18. The system of 15, wherein the processor is coupled to the drill string at a downhole location, the system further comprising a downhole memory device for storing the processed signal.

19. The system of claim 18 further comprising a transmitter for transmitting to a surface location selected values from the stored signals.

20. The system of claim 15, wherein each of the plurality of extendable gripper elements includes a pad mounted on the gripper element to increase frictional force between the borehole wall and the gripper element, the pad having a conical shape pressed into mudcake when the extendable gripper element engages the borehole wall.

21. The system of claim 15, wherein each of the plurality of extendable gripper elements includes a textured pad mounted on the gripper element to increase frictional force between the borehole wall and the gripper element.

22. The system of claim 21, wherein each of the textured pads includes a surface pattern selected from one or more of i) diamond; ii) raised points; iii) ridges; iv) grooves; v) dimpled; vi) cross hatch; and vi) circular.

23. The system of claim 21, wherein the extendable gripper element further includes one or more pistons operable to extend the pad to engage the borehole wall.

24. The system of claim 21, wherein the pad is a single elongated pad attached to a housing using at least one of i) a flexible member coupling the pad to the housing end ii) a member coupling the pad to the housing at a pivot point.

25. The system of claim 15 further comprising a hydraulic drive device for supplying hydraulic pressure to extend the plurality of gripper elements.

26. The system of claim 25, wherein the hydraulic drive device comprises a motor and a pump for pumping drilling fluid at high pressure to extend the plurality of gripper elements.

27. The system of claim 15, wherein the diverter valve includes a piston and a seal axially moveable by the piston to seal a main mud stream flow path and open an aperture for allowing the mud stream to enter the annulus.

28. The system of claim 15 further comprising an expandable packer coupled to the drill string below the diverter valve to isolate the test device from pressure variations in the annulus while the diverter valve is diverting fluid.

29. The system of claim 15, wherein the test device comprises an extendable probe adapted to admit formation fluid into the test device, wherein the desired characteristic sensed by the sensor relates to the admitted fluid.

30. The system of claim 15, wherein the drill string portion comprises a selectable non-rotating sleeve coupled to the drill string.

31. The system of claim 30, wherein the test device is adapted to determine the parameter of interest while a drill bit connected to the drill string progresses through the formation.

32. The system of claim 15, wherein the sensed characteristic includes one or more of i) temperature; ii) pressure; iii) formation fluid composition; iv) resistivity; v) water content; vi) mobility; and vi) nuclear properties.

33. A method of isolating a downhole test device from noise, comprising:

a) conveying a drill string into a well borehole, the drill string having an inner bore for conveying drilling fluid;

b) anchoring a drill string portion to a borehole wall using a plurality of extendable gripper elements disposed on the drill string adjacent to the test device;

c) diverting drilling fluid from the inner bore of the drill string into an annulus surrounding the drill string portion using a diverter valve to reduce hydraulic noise at the test device; and d) obtaining a desired characteristic using a sensor disposed on the anchored drill string portion.

34. The method of claim 33, wherein anchoring the drill string portion includes engaging the borehole wall with a pad mounted on each of the plurality of extendable gripper elements to increase frictional force between the borehole wall and the gripper element, each pad having a conical shape pressed into a mudcake when the extendable gripper elements engage the borehole wall.

35. The method of claim 33, wherein anchoring the drill string portion includes engaging the borehole wall with a textured pad mounted on each of the plurality of extendable gripper elements to increase frictional force between the borehole wall and the gripper element.

36. The method of claim 35, wherein each textured pad includes a surface pattern selected from one or more of i) diamond; ii) raised points; iii) ridges; iv) grooves; v) dimpled; vi) cross hatch; and vi) circular.

37. The method of claim 33 further comprising supplying hydraulic pressure to extend the plurality of gripper elements using a hydraulic drive device.

38. The method of claim 33, wherein diverting the drilling fluid includes sealing the drill string inner bore using a piston and a seal axially moveable by the piston and opening an aperture for allowing the drilling fluid to enter the annulus uphole of the test device.

39. The method of claim 33 further comprising isolating the test device from pressure variations in the annulus while the diverter valve is diverting fluid using an expandable packer coupled to the drill string below the diverter valve.

40. The method of claim 33, wherein the obtaining a desired characteristic includes extending a fluid admitting probe to engage the formation and wherein the characteristic related to the admitted fluid.

41. The method of claim 33, wherein the drill string portion comprises a selectable non-rotating sleeve coupled to the drill string and wherein anchoring the drill string portion comprises anchoring the non-rotating sleeve.

42. The method of claim 41, further comprising obtaining the desired characteristic while a drill bit connected to the drill string progress through the formation.

43. The method of claim 33, wherein the sensed characteristic includes one or more of i) temperature; ii) pressure; iii) formation fluid composition; iv) resistivity; v) water content: vi) mobility; and vii) nuclear properties.

* * * * *